252-146 AU 157 EX
5/6/86 XR 4,587,030

United States Patent [19]
Casey

[11] Patent Number: 4,587,030
[45] Date of Patent: May 6, 1986

[54] FOAMABLE, ACIDIC CLEANING COMPOSITIONS

[75] Inventor: Sheryl K. Casey, Eagan, Minn.

[73] Assignee: Economics Laboratory, Inc., St. Paul, Minn.

[21] Appl. No.: 618,923

[22] Filed: Jun. 13, 1984

Related U.S. Application Data

[63] Continuation-in-part of Ser. No. 510,946, Jul. 5, 1983, abandoned.

[51] Int. Cl.[4] ..... C11D 17/00; C11D 7/08

[52] U.S. Cl. ..... 252/92; 252/90; 252/142; 252/143; 252/146; 252/148; 252/525; 252/544; 252/DIG. 10; 252/DIG. 14

[58] Field of Search ..... 252/90, 92, 142, 143, 252/146, 148, 174.21, 525, 544, DIG. 10, DIG. 13, DIG. 14

[56] References Cited

U.S. PATENT DOCUMENTS

| | | | |
|---|---|---|---|
| 3,211,659 | 10/1965 | Pikaar | 252/142 |
| 3,533,955 | 10/1970 | Pader et al. | 252/DIG. 13 |
| 3,755,559 | 8/1973 | Hewitt | 424/70 |
| 3,822,212 | 7/1974 | Bryant et al. | 252/143 |
| 3,943,234 | 3/1976 | Roggenkamp | 252/143 |
| 4,056,113 | 1/1977 | Johnson et al. | 134/40 |
| 4,140,648 | 2/1979 | Thompson et al. | 252/90 |
| 4,169,817 | 10/1979 | Weber | 252/545 |
| 4,181,623 | 1/1980 | Dillarstone | 252/142 |
| 4,235,734 | 11/1980 | Scherubel | 252/142 |
| 4,326,971 | 4/1982 | Wixon | 252/875 |

FOREIGN PATENT DOCUMENTS

| | | |
|---|---|---|
| 105496 | 6/1982 | Japan . |
| 200802B | 1/1979 | United Kingdom . |
| 2075043A | 11/1981 | United Kingdom . |
| 1602234 | 11/1981 | United Kingdom . |

*Primary Examiner*—Paul Lieberman
*Assistant Examiner*—Hoa Van Le
*Attorney, Agent, or Firm*—Merchant, Gould, Smith, Edell, Welter & Schmidt

[57] ABSTRACT

Soil comprising soap scum and hardness components can be efficiently removed by an acidic cleaning composition which comprises a major proportion of water, an acidic component comprising a mixture of a weak organic acid and a weak inorganic acid, a surfactant system comprising a major proportion of an amine oxide surfactant and a cosolvent, which is preferably applied to the soil as a foam from a pumpable or pressurized container.

18 Claims, No Drawings

FOAMABLE, ACIDIC CLEANING COMPOSITIONS

CROSS REFERENCE TO RELATED APPLICATION

This application is a continuation-in-part of U.S. application Ser. No. 510,946, filed July 5, 1983 now abandoned.

FIELD OF THE INVENTION

The invention relates to liquid, foamable cleaning compositions which can be used in household or industrial environments to clean surfaces soiled by the presence of organic and inorganic soils including soap scum, hardness components, grease and the like. More particularly, the invention relates to sprayable, foamable acidic cleaning compositions.

BACKGROUND OF THE INVENTION

Sprayable cleaners have been used for many years for both household and institutional cleaning of a variety of organic and inorganic soils such as food residue, soap scum, grease, hardness components and the like. Commonly these cleaners comprise a major proportion of a solvent such as water or a mixed aqueous-organic solvent, and components such as chelating agents, including EDTA, NTA, and others; anionic, nonionic and cationic surfactants, disinfectants, fragrances and dyes. These spray cleaners are usually formulated at a near-neutral pH (about 7) up to an alkaline pH (up to about 12). These cleaners perform adequately on many soils, however in certain applications neutral or basic cleaners have had the drawback that certain soils, such as hardness components (calcium and magnesium salts precipitated from hard water) and soap scum (a precipitated calcium soap salt) can be very difficult to clean since these soils are less soluble at a basic pH. An acidic cleaner is indicated for soil removal in these instances.

However, acidic cleaners pose certain problems in use and formulation. Many surfactants are insoluble or will hydrolyze at an acid pH. Many fragrances are unstable at low pH. Although strong inorganic acids, such as hydrochloric or sulfuric acid readily attack basic soils, their use in water-based cleaning compositions can irritate or burn the user's skin and degrade metallic and painted surfaces. When sprayed, such cleaners can also create an acidic mist or fog which can cause eye irritation and damage, and if inhaled can cause nose and throat irritation and coughing. If inhaled in sufficient amounts such cleaners could result in lung damage. For these reasons, sprayable acidic cleaners have not drawn the attention that has been given to the development of sprayable neutral or basic cleaning compositions. However, a substantial need has arisen for an acidic cleaner which can be used to efficiently remove soils including mineral hardeners, soap scums, dirt, grease and body oil which are found in institutional and household bathrooms and kitchens.

Despite the advantages inherent in foamable acidic cleaning compositions, such as reduction of aerosol dispersion, high cling and visibility, etc., few have been disclosed to date, probably due to the fact that the strong acids thought to be necessary for effective cleansing power both destabilize foam and degrade the surfactants necessary to foam the composition.

Scherubel (U.S. Pat. No. 4,235,734) generally discloses that foamable cleaning compositions may be prepared employing acids, cationic or nonionic surfactants and an alkanol or inertly-substituted alkanol such as butyl carbitol. The alkanol is disclosed to stabilize the foam. The compositions disclosed in the Scherubel patent comprise solutions of the strong acid, hydrochloric acid, and a surfactant mixture primarily composed of a cationic "quat" surfactant.

Thus a need exists for an effective foamable cleaning composition comprising an aqueous solution of one or more weak acids and a compatible cleansing and foam-forming solvent and surfactant system.

BRIEF DESCRIPTION OF THE INVENTION

I have found that effective aqueous foamable, acidic cleaning compositions can be prepared by combining a major proportion of water, an acidic component comprising a mixture of a weak inorganic acid and a weak organic acid, an effective amount of an amine oxide surfactant of the formula:

$$(R_1)(R_2)(R_3)N \rightarrow O$$

and a cosolvent which can maintain the components in a stable aqueous solution and enhance the cleaning power of the composition.

I have formulated many combinations of surfactant, solvent, acid, and water but I have found that they provide minimal cleaning activity while the acidic cleaning composition of this invention combines a surprisingly high degree of cleaning strength with ease of application and safety.

DETAILED DESCRIPTION OF THE INVENTION

Briefly, the foamable, sprayable acidic cleaning compositions of this invention are formed from a major proportion of water, an acidic component comprising a mixture of a weak inorganic acid and a weak organic acid, a specific high dipole moment amine oxide detergent, and a consolvent which is preferably an alkanol or an alkoxy-substituted alkanol.

The acidic component used to prepare the sprayable, foamable acidic compositions of the invention will comprise a mixture of a weak inorganic acid and a weak organic acid which can be dissolved in the aqueous organic cosolvent system of the invention to produce an acidic pH in the range of about 1 to 5. A pH substantially less than about 1 can result in substantial corrosion of metal and other surfaces common in the cleaning environment, while a pH greater than about 5 can unacceptably reduce the cleaning efficiency of the composition.

The term "weak" as used in reference to an acidic component is intended to refer to an acid in which the first dissociation step does not proceed essentially to completion when the acid is dissolved in water at ambient temperatures at a concentration within a range useful to form the present compositions. Such inorganic and organic acids are also referred to as weak electrolytes as the term is used in *Textbook of Quantitative Inorganic Analysis*, I. M. Kolthoff et al., eds., The Macmillan Co. (3d ed., 1952) at pages 34–37, the disclosure of which is incorporated by reference herein.

Most common commercially-available weak inorganic and organic acids can be used in the invention. Examples of weak inorganic acids include phosphoric acid and sulfamic acid. Useful weak organic acids include acetic acid, hydroxyacetic acid, citric acid, benzoic acid, tartaric acid and the like. I have found in many applications that a mixture of a weak organic and a weak inorganic acid in the composition can result in a surprising increase in cleaning efficacy. Preferred cleaning systems comprise the combination of sulfamic acid or phosphoric acid and an organic acid such as citric acid, acetic acid, or hydroxyacetic acid (glycolic acid). The most preferred acid cleaning system comprises either sulfamic acid or phosphoric acid and hydroxyacetic acid.

In the case of phosphoric acid-hydroxy acetic acid systems, the weight ratio of phosphoric acid to hydroxyacetic acid is preferably about 15:1 to 1:1, most preferably about 5–1.5:1. I have found that one type of difficult soil to remove from surfaces appears to be $CaHPO_4$. This component is part of many soils and can be a result of the interaction between hardness components and acid-containing cleaners using phosphoric acid as the acidic component. We believe a mixture of hydroxyacetic acid with the phosphoric acid in the acidic cleaner can optimize cleaning properties. However, in some locales, the phosphate content permitted in cleansing compositions is restricted or must be limited to a negligible amount. Surprisingly, I discovered that effective phosphate-free compositions could be formed which employ sulfamic acid-hydroxy acetic acid systems in which the amount of hydroxy acetic acid exceeds the amount of sulfamic acid present. In such systems, the weight ratio of hydroxy acetic acid to sulfamic acid is preferably about 5–1:1, most preferably about 3–1:1.

The surfactant we have found which cooperates with the other components of the invention to provide the highly efficient cleaning properties of the invention is a surfactant which has not been commonly used in sprayable cleaners and is most commonly used as a foam stabilizer in shampoos and other cosmetic systems. The surfactants used in the sprayable, foamable acidic cleaners of this invention comprise amine oxides having the formula:

$$(R_1)(R_2)(R_3)N \rightarrow O$$

wherein $R_1$ is a $C_8$–$C_{20}$-alkyl or $C_8$–$C_{20}$-alkylamido-$C_2$–$C_5$-alkyl group and $R_2$ and $R_3$ are individually $C_1$–$C_4$-lower alkyl or hydroxy-$C_1$–$C_4$-lower alkyl. Preferably $R_2$ and $R_3$ are both methyl, ethyl or 2-hydroxyethyl. Preferred members of this class include lauryl(dimethyl)amine oxide (Ninox® L, Stephan Chemical Co., Northfield, IL), cocodimethyl amine oxide (Ninox® C), myristyl(dimethyl)amine oxide (Ninox® M), stearyl(dimethyl)amine oxide (Schercamox® DMS, Scher Chemicals, Inc., Clifton, N.J.), coco(bix-hydroxyethyl)amine oxide (Schercamox® CMS), tallow(bis-hydroxyethyl)amine oxide and cocoamidopropyl(dimethyl)amine oxide (Ninox® CA). Although in alkaline solutions these surfactants are nonionic, in acidic solutions they adopt cationic characteristics. Preferably, the amine oxide surfactants will comprise about 1–15% of the present compositions, most preferably about 2–10%.

Minor amounts of nonionic surfactants may also be included in the present compositions to augment the soil dispersal power of the amine oxide, but such surfactants will commonly not exceed 25% of the total surfactant present. Useful nonionic surfactants include the polyethylenoxy condensates of $C_1$–$C_{10}$-alkyl-substituted phenols, e.g. the condensation products of 8–10 moles of ethylene oxide with nonylphenol (Igepal® 610, 630 and 710, respectively, available from GAF). Other useful nonionic surfactants include the condensation products of ethylene oxide with a hydrophobic polyoxyalkylene base formed by the condensation of propylene oxide with propylene glycol (the Pluronic® series, BASF Wyandotte), the condensation products of $C_8$–$C_{22}$-alkyl alcohols with 2–50 moles of ethylene oxide per mole of alcohol, the ethylene oxide esters of alkyl mercaptans, the ethylene oxide esters of fatty acids, the ethylene oxide ethers of fatty acid amides and other similar materials. When present, nonionic surfactants will preferably comprise about 0.25–3% of the total composition, most preferably about 0.5–1.5%.

The cosolvent used to maintain the stability of the foamable, acidic cleaners of this invention will include any solvent miscible in water that can maintain a stable solution of the amine oxide surfactant and acid in aqueous media. Preferred cosolvents are alcohols and the mono and di-alkyl ethers of alkylene glycols, dialkylene glycols, trialkylene glycols, etc. Alcohols which are useful as cosolvents in this invention include methanol, ethanol, propanol and isopropanol. Particularly useful in this invention are the mono and dialkyl ethers of ethylene glycol and diethylene glycol, which have acquired trivial names such as polyglymes, cellosolves, and carbitols. Representative examples of this class of cosolvent include methyl cellosolves, butyl carbitol, dibutyl carbitol, diglyme, triglyme, etc. For reasons of low cost, commercial availability, and solvent strength, a $C_2$–$C_6$ alkyl carbitol is preferred. The most preferred cosolvent of this invention comprises butyl carbitol. These preferred cosolvents help reduce surface tension, help solubilize grease and soap scum, and maintain the foamable, acidic cleaner at a stable single phase system.

Commonly the acid components are present in the cleaners in a total amount of from about 5 to 25 wt-% of the cleaner. The preferred sulfamic acid or phosphoric acid-hydroxy acetic acid system is commonly present in amounts of about 5 to about 15 wt-% of the cleaner. At this concentration the preferred acidic components of the cleaner are highly efficient in the removal of hardness components at a low ingredient cost in combination with substantial user safety.

The total surfactants of the foamable, sprayable acidic cleaner of this invention can be present in a concentration of about 2 to about 15 wt-% of the composition. Preferably, for reasons of high activity and reduced cost, the surfactants of the invention are present in the cleaner at concentrations of about 3 to about 12 wt-%, most preferably about 2.5–6.5 wt-%. The amine oxide surfactants will make up the major portion of this amount, preferably comprising about 50–100% of the total surfactant system, most preferably about 75–100%.

The cosolvent cleaner stabilizer component of the foamable acidic cleaner of the invention can be present in amounts ranging from about 1 to about 15 wt-% of the composition. Preferably, to aid in soap scum removal and to reduce surface tension, a cosolvent comprising an ethylene glycol mono or dialkyl ether is used at a concentration of about 2.5 to 10 wt-%. The most preferred cosolvent for use in the pumpable, foamable acidic cleaner of the invention comprises a $C_2$–$C_5$ alkyl carbitol, which is used at a concentration of about 2.5–5 wt-%. Minor but effective amounts of an acid-stable thickener may be added, if desired, to improve the stability and cling of the foamed composition. Useful thickeners include xanthan gum (Kelzan ® Merck) and polyvinylpyrrilidone. Whem employed, such thickeners will commonly be present at about 0.1-5% by weight of the composition.

The sprayable, foamable acidic compositions of this invention can be formulated by any convenient means. The components can be dissolved or suspended in water and agitated until a solution is obtained. Generally, the order of addition of components is not important, however for reasons of ease of manufacture and initial cleaner stability, the acidic components are dissolved in the water phase, then the cosolvent can be added, and finally, the amine oxide-comprising surfactant composition is added to the agitated, uniform mixture. The components are then blended in the aqueous system to provide a final pH that ranges from about 1 to about 5 at a 1% concentration of the cleaner in soft water or in service or tap water. Preferably, the pH of the final solution ranges between 1.5 and 3 in a 1% solution of the cleaner in service or tap water, and most preferably the pH of the final cleaning solution ranges from about 2 to 3. At this pH the cleaner is stable and provides surprisingly high cleaning power.

The foamable, pumpable acidic cleaning composition of this invention is designed to be applied to soiled surfaces in a form other than a spray. Spraying means such as pump sprayers or aerosol sprayers which employ nozzles resulting in a substantial amount of finely divided mist or fog droplets of the cleaner suspended in the air are not preferred, since such a suspension of cleaner can be an extreme nuisance, and can in some instances cause damage to the eyes and respiratory tissues of the user. The present cleaner can be applied as a liquid, as a thickened liquid or as a foam. Liquid applicators can have push-pull tops, toggle tops, or sponge applicators. Preferably, foam applicating means which can apply at least a 1 millimeter layer of foam to a surface without substantial spray production are preferred. Foam generating containers comprising means employing a pump-action or an aerosol propellant are known to persons skilled in the art. When filled or otherwise loaded with the present acidic compositions, these containers form the foam generating systems of this invention. One preferred foam generator comprises a hand-operated pump which is the subject of U.S. Pat. Nos. 4,350,298; 4,230,277; and 4,153,203, the disclosures of which are incorporated by reference herein. This foam applicator means can apply a layer of foam to both horizontal and vertically fixed surfaces ranging in thickness from about 1 millimeter to as much as 30 millimeters. However, for reasons of cleaning efficiency and economy, a foam layer of about 2 to 10 millimeters is preferred. After the application of the foam to the soiled surface, the foam can be permitted to act on the soil and can then be rinsed or wiped away using a clean, absorbent material. In the instance that more stubborn soils are present, the cleaner can be applied to the surface and the soil can be disturbed using brushing means or scraping means which tend to disrupt the surface of the soil, permitting the activity of the acidic cleaner to contact finely divided particles of the soil. However, most common soils are removed by a single application of a modest amount of the pumpable, foamable acidic cleaner of the invention without substantial brushing or scraping of soil. A substantial advantage of this invention is that easily scratched fiberglass, glass and plastic installations in household bathrooms can be cleaned of water hardeners and soap scum and shined easily with one application of the cleaner, which is then rinsed or removed with an absorbent material.

The invention is further illustrated by the following specific Examples, which should not be used in unduly limiting the scope of the invention or the claims. In the Examples, all parts are in parts by weight or in weight-% unless otherwise specifically indicated.

EXAMPLE I

Into a 500 ml. beaker were placed 65.4 parts of soft water and 23.2 parts of 75% aqueous phosphoric acid. The mixture was stirred until uniform and 9.6 parts of a 70% aqueous solution of hydroxy acetic acid was added and stirred until uniform. Into the uniform mixture was placed 1.0 parts of an ethoxylated nonylphenol surfactant (IGEPAL ® CO-630) and 0.07 parts of methylsalicylate fragrance. The mixture was stirred until uniform and was drawn off into a pump foamer.

EXAMPLE II

Into a 500 ml. glass beaker were placed 74.3 parts of water and 11.6 parts of 75% aqueous phosphoric acid. The mixture was stirred until uniform and 4.8 parts of a 70% aqueous hydroxy acetic acid solution added. The mixture was stirred until uniform and 4.0 parts of butyl cellosolve was added to the mixture along with 1.0 parts of a polyethyloxynonylphenol surfactant (IGEPAL ® CO-630), 0.20 parts of methylsalicylate fragrance, a trace of blue tint, and four parts of lauryl(dimethyl)amine oxide surfactant (Ninox ® L). The mixture was stirred until uniform and was drawn off into plastic foam producing bottles.

EXAMPLE III

Example II was repeated except that 4 parts of methyl cellosolve was substituted for the 4 parts of butyl cellosolve.

EXAMPLE IV

Example II was repeated except that 4 parts of butyl carbitol was substituted for 4 parts of butyl cellosolve.

EXAMPLE V

Into a stainless steel mixing vessel equipped with heating, cooling and propeller stirring was placed 77.3 parts of soft water and agitation was begun. To the agitated water was added 3.5 parts sulfamic acid along with 10 parts of hydroxy acetic acid technical grade (70%). After agitation until the mixture became uniform, 4 parts of diethylene glycol monobutyl ether, 0.2 parts fragrance, a trace of blue dye and 4 parts lauryl(-dimethyl)amine oxide (lauramine oxide) were blended into the batch until homogeneous. The liquid was drawn off and bottled in 16 oz. spray containers.

EXAMPLE VI

Into a 500 ml. glass beaker was placed 76 parts of deionized water. Into the water was placed 10 parts of a 75% aqueous solution of phosphoric acid. The mixture was agitated until uniform and 10 parts of a 50% active aqueous solution of citric acid was added. After mixing until uniform, 2 parts of diethylene glycol monobutyl ether was added to the mixture with continued agitation. After uniform, 2 parts of lauramine oxide was added and the mixture was stirred until blended, was drawn off into polyethylene bottles and capped.

EXAMPLE VII

Into a 500 ml. beaker were placed 64.4 parts of soft water, 11.6 parts of 75% aqueous phosphoric acid, and 4.8 parts of a 70% aqueous solution of hydroxy acetic acid. The solution was mixed until uniform and 4.0 parts of diethyleneglycol monobutyl ether were added along with 4 parts of cocamidopropyl(dimethyl)amine oxide. The mixture was blended until uniform and was drawn off into polyethylene bottles.

EXAMPLE VIII

Into suitable mixing equipment was placed 75.5 parts of deionized water at a temperature of 25° C. Into the water, with stirring, was added 11.6 parts of a 75% aqueous solution of phosphoric acid. The mixture was stirred until uniform, 4.81 parts of 70% aqueous hydroxy acetic acid was added. The resulting mixture was stirred until uniform, and into the solution was added 4 parts of lauryl(dimethyl)amine oxide along with 4 parts by weight of butyl carbitol. The mixture was stirred until uniform, drawn from the mixing equipment, and stored in 1 gallon plastic bottles. A 1% solution of the above composition is deionized water exhibited a pH of 2.3.

The above products of Examples I–IV were tested on soiled shower stalls and sinks having soap scum, body oils and water hardness precipitates on their surfaces. The product of Example II was found to be substantially better than a commercially available cleaner and substantially better than the product of Example I which has no amine oxide surfactant or cosolvent. The product of Example II was found to be substantially better than a commercially available bathroom cleaner, and substantially better than the product of Example I. The product of Example III was found to be substantially better than a commercially available bathroom cleaner and the product of Example I. The product of Examples II and IV appeared to be approximately equal in cleaning efficacy and substantially better than the product having methyl cellosolve, indicating a preference for the higher alkyl ether. The product of Example V is about equal in effectiveness to the product of Example IV.

The foregoing description, Examples, and data are illustrative of the invention described herein, and should not be used to unduly limit the scope of the invention or claims. Since many embodiments and variations can be made while remaining within the spirit and scope of the invention, the invention resides wholly in the claims hereinafter appended.

What is claimed is:

1. A foam-producing system which comprises a container, having a foam generating means, which contains an acidic cleaning composition comprising:

a major proportion of water;

a sufficient amount of an acidic component comprising a mixture of a weak inorganic acid and a weak organic acid to provide a pH of about 1 to 5 in a 1% solution in water of the cleaning composition;

an effective amount of a cationic surfactant having the formula:

$$(R_1)(R_2)(R_3)N\rightarrow O$$

wherein $R_1$ is a $C_8$–$C_{20}$-alkyl or $C_8$–$C_{20}$-alkylamido-$C_2$–$C_5$-alkyl and $R_2$ and $R_3$ are individually $C_1$–$C_4$-lower alkyl or hydroxy-$C_1$–$C_4$-lower alkyl; and, an effective amount of a cosolvent which can reduce surface tension and maintain the cleaning components in a stable mixture;

wherein the foam generator produces a layer of cohesive foam having a depth of about 1 to about 30 millimeters in the substantial absence of airborn spray or mist of the cleaning composition.

2. The system of claim 1 wherein the foam producing means comprises an aerosol foam producing means having the acidic cleaning composition in combination with a prepellant.

3. The system of claim 1 wherein the foam producing means comprises a hand-operated pump foamer.

4. The system of claim 1 wherein the inorganic acid comprises phosphoric acid or sulfamic acid and the organic acid comprises acetic acid, citric acid, hydroxy acetic acid and mixtures thereof.

5. The system of claim 1 wherein the acid component is present at a concentration of about 5 to 15 wt-% of the foamable, pumpable acidic composition and comprises a mixture of phosphoric acid and hydroxy acetic acid, containing about 1.5 to 5 parts of phosphoric acid per each part of hydroxy acetic acid.

6. The system of claim 1 wherein the acidic component comprises a mixture of sulfamic acid and hydroxy acetic acid, containing about 5 to 1 parts of hydroxy acetic acid per each part of sulfamic acid, wherein the mixture of acids is present at a concentration of about 5 to 15 wt-% of the pumpable foamable acidic composition.

7. The system of claim 1 wherein the surfactant comprises a surfactant of the formula:

$$(R_1)(R_2)(R_3)N\rightarrow O$$

wherein $R_2$ and $R_3$ are both methyl, ethyl or 2-hydroxyethyl, and which surfactant is present at a concentration of about 1 to about 10 wt-% of the foamable acidic composition.

8. The system of claim 1 wherein the cosolvent comprises a water-miscible alcohol or a mono or diether of an alkylene glycol, dialkylene glycol, or trialkylene glycol.

9. The system of claim 8 wherein the cosolvent comprises a mono(alkyl) ether of diethylene glycol which is present at a concentration of about 1 to about 15 wt-% of the foamable, pumpable acidic cleaner.

10. A pumpable, foamable acidic cleaning composition which consists essentially of:

a major proportion of water;

a sufficient amount of an acidic component incorporating a mixture of a weak inorganic acid and a weak organic acid to provide a pH of about 1 to 5 in a 1% solution in water of the cleaning composition;

an effective amount of a surfactant mixture comprising about 50–100% of a cationic amine oxide of the formula:

$$(R_1)(R_2)(R_3)N\rightarrow O$$

wherein $R_1$ is a $C_8$–$C_{20}$-alkyl or $C_8$–$C_{20}$-alkylamido-$C_2$–$C_5$-alkyl and $R_2$ and $R_3$ are individually methyl, ethyl or 2-hydroxyethyl; and, an effective amount of a cosolvent which can reduce surface tension and maintain the cleaning components in a stable mixture.

11. The composition of claim 10 wherein the inorganic acid comprises phosphoric acid or sulfamic acid and the organic acid comprises acetic acid, citric acid, hydroxy acetic acid and mixtures thereof.

12. The composition of claim 10 wherein the acid component is present at a concentration of about 5 to 15 wt-% of the pumpable foamable acidic composition, and comprises a mixture of phosphoric acid and hydroxy acetic acid, containing about 1.5 to 5 parts of phosphoric acid per each part of hydroxy acetic acid.

13. The composition of claim 10 wherein the acid component is present at a concentration of about 5 to 15 wt-% of the pumpable foamable acidic composition, and comprises a mixture of sulfamic acid and hydroxy acetic acid, containing about 5 to 1 parts of hydroxy acetic acid per each part of sulfamic acid.

14. The composition of claim 10 wherein the surfactant mixture comprises about 75–100% of an amine oxide of the formula:

$$(R_1)R_2)(R_3)N \rightarrow O$$

wherein both $R_2$ and $R_3$ are methyl, ethyl or 2-hydroxyethyl and which amine oxide is present at a concentration of about 1 to about 10 wt-% of the foamable acidic composition.

15. The composition of claim 10 wherein the cosolvent comprises a water-miscible alcohol or a mono or diether of an alkylene glycol, dialkylene glycol or trialkylene glycol.

16. The composition of claim 15 wherein the cosolvent comprises a mono (alkyl) ether of diethylene glycol which is present at a concentration of about 1 to about 15 wt-% of the foamable, pumpable acidic composition.

17. The composition of claim 15 which also contains about 0.1–5% of an acid-stable thickener.

18. The composition of claim 10 wherein the surfactant mixture also contains a nonionic sufactant.

* * * * *